US010113373B2

(12) United States Patent
Baynham et al.

(10) Patent No.: US 10,113,373 B2
(45) Date of Patent: Oct. 30, 2018

(54) CENTRALISER

(71) Applicant: ADVANCED COMPOSITE INDUSTRIES AG, Kastanienbaum (CH)

(72) Inventors: Richard Ronald Baynham, Marina di Ravenna (IT); David E. Y. Levie, Kataniebaum (CH)

(73) Assignee: INNOVEX DOWNHOLE SOLUTIONS, INC., The Woodlands, TX (US)

( * ) Notice: Subject to any disclaimer, the term of this patent is extended or adjusted under 35 U.S.C. 154(b) by 177 days.

(21) Appl. No.: 14/911,976

(22) PCT Filed: Aug. 13, 2014

(86) PCT No.: PCT/EP2014/067368
§ 371 (c)(1),
(2) Date: Feb. 12, 2016

(87) PCT Pub. No.: WO2015/022381
PCT Pub. Date: Feb. 19, 2015

(65) Prior Publication Data

US 2016/0201406 A1 Jul. 14, 2016

(30) Foreign Application Priority Data

Aug. 13, 2013 (GB) ..... 1314473.8

(51) Int. Cl.
*E21B 17/10* (2006.01)

(52) U.S. Cl.
CPC ..... *E21B 17/1078* (2013.01); *E21B 17/1028* (2013.01); *E21B 17/1021* (2013.01); *E21B 17/1042* (2013.01)

(58) Field of Classification Search
CPC ..... E21B 17/1021; E21B 17/1028; E21B 17/1078; E21B 17/1042
See application file for complete search history.

(56) References Cited

U.S. PATENT DOCUMENTS 1,898,074 A * 2/1933 Bailey ..... E21B 17/1021 15/104.061
3,282,349 A * 11/1966 Cobbs ..... E21B 17/1028 166/172

(Continued)

FOREIGN PATENT DOCUMENTS

WO 2004/015238 A1 2/2004
WO 2009/047536 A1 4/2009

*Primary Examiner* — Robert E Fuller
*Assistant Examiner* — Christopher J Sebesta
(74) *Attorney, Agent, or Firm* — MH2 Technology Law Group LLP

(57) ABSTRACT

A composite material centralizer (60) for a tubular (50) is formed from a shell (10) of elongate shape with a curved upper surface (12) and a longitudinal slot (14) formed centrally in the curved upper surface (12) of the shell (10). At least one port (19) for injection of a bonding agent into the cavity (26) is provided in the curved upper (surface (12) of the shell (10). Fluid vent holes (17) are provided in the curved upper surface (12) of the shell (10) adjacent to either end of the longitudinal slot (14) in the curved upper surface (12) of shell (10). An elongate resilient member (30) with an outwardly projecting bow spring surface (33) may be retained within the longitudinal slot (14) in the shell (10) by insertion of ends (31, 32) in respective recesses (24, 24').

19 Claims, 3 Drawing Sheets

(56) References Cited

U.S. PATENT DOCUMENTS

| | | | | |
|---|---|---|---|---|
| 2007/0284037 | A1* | 12/2007 | Buytaert | E21B 17/1028 156/294 |
| 2012/0186828 | A1* | 7/2012 | Lively | E21B 17/1028 166/381 |
| 2013/0233568 | A1* | 9/2013 | Levie | E21B 17/1028 166/381 |
| 2013/0248206 | A1* | 9/2013 | Jordan | E21B 19/24 166/381 |

* cited by examiner

CENTRALISER

CROSS REFERENCE TO RELATED APPLICATIONS

This application is a U.S. National Stage application of PCT/EP2014/067368, filed Aug. 13, 2014, which claims priority to British application No. 1314473.8, filed Aug. 13 2013, the contents of all of which are hereby incorporated by reference in their entirety.

This disclosure relates to a device for centring a tubular body (hereinafter "tubular") in a bore such that sufficient annular spacing is provided when the tubular is positioned in the bore.

BACKGROUND

Recovery of gaseous and liquid hydrocarbons from petroleum reservoirs often requires drilling of boreholes into the formations in which the petroleum reservoirs are to be found. Some petroleum reservoirs are in subsea formations. In some instances deviated or lateral boreholes are required to access the petroleum reservoirs. Deep boreholes may pass through multiple strata of complex and differing geological characteristics before penetrating the formation of interest.

A risk frequently encountered in any such boreholes is one of bore wall collapse due to instability in the surrounding formation. This is addressed in the industry by introducing tubulars such as casing and liner sections which are cemented into place after positioning. As the bore depth increases, successively narrower tubulars may be positioned in the bore and the overlap zone between the tubulars may be at least about 30 meters which also requires cementing.

It is important that the cement surrounds the introduced tubular to secure and seal it in position. Therefore it is also important to ensure an adequate clearance between the introduced tubular and the bore wall or previously installed casing tubular to admit the appropriate amount of cement and allow proper distribution around the introduced tubular.

Use of centralisers has been proposed as an approach to position tubulars centrally within the bore. These centralisers are of generally cylindrical shape and may comprise rigid bodies, or bow spring elements positioned between end collars to be slipped over a tubular. Alternatively the centraliser may be of a hinged segmented type with lockable end bands to encircle the tubular.

Difficulties with centralisers may be encountered where restrictions in the bore diameter have to be traversed, in which case the centraliser may not pass the restriction. Alternatively, a centraliser may have insufficient width when introducing a tubular through a bore or casing of one width dimension to one where the bore is widened such as for example in an underreamed well zone.

SUMMARY

The present disclosure provides a centraliser which may obviate or mitigate the abovementioned difficulties. Embodiments of the centraliser and its manner of manufacture and assembly will now be described by way of illustrative examples with reference to the accompanying drawings in which.

DETAILED DESCRIPTION OF EMBODIMENTS

Figure 1:
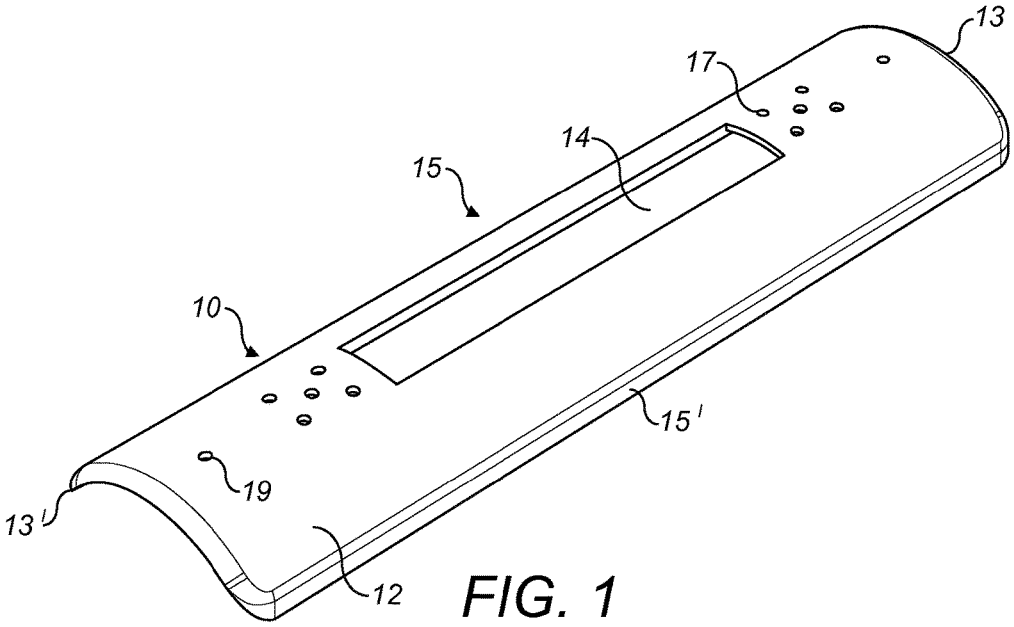
FIG. 1 is a perspective view from above and to one side of a shell to be used as a centraliser housing.
Figure 2:
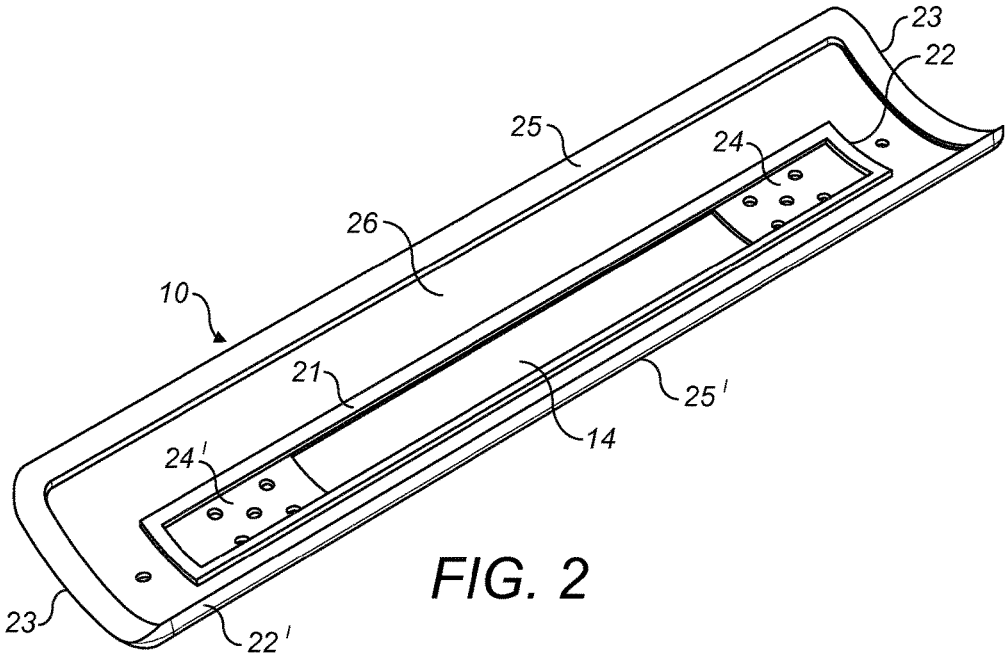
FIG. 2 is a perspective view from below and to one side of a shell to be used as a centraliser housing.

Referring initially to FIGS. 1 and 2, a shell 10 for use as a housing in assembly of a centraliser has an elongate shape which is substantially rectilinear when viewed towards its major surface 12. The shell 10 may have an arcuate cross section wherein the major surface 12 is a curved upper surface 12, and shallow side walls 13, 13', 15, 15' defining under the curved upper surface 12, a cavity 26 (FIG. 2) within the shell 10.

An aperture or longitudinal slot 14 may be formed centrally in the curved upper surface 12 of the shell 10. Fluid vent holes 17 are provided in the curved upper surface 12 of the shell 10 adjacent to either end of the longitudinal slot 14 in the curved upper surface 12 of shell 10.

At least one port 19 for injection of a bonding agent into the cavity 26 is provided in the curved upper surface 12 of the shell 10. Such a port 19 may be provided at either end of the shell 10, or at other locations in the shell 10.

The illustrated shell 10 exhibits reflection symmetry in a plane bisecting the longitudinal axis at a mid-point, and so either end may be the "leading end" when the shell 10 is installed to serve as a housing.

Figure 5:
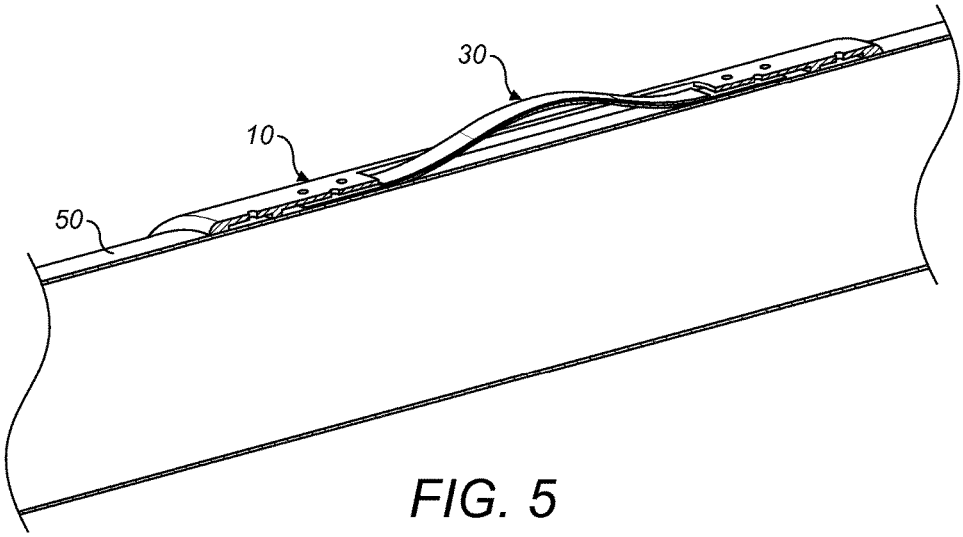
FIG. 5 is a cutaway view, in longitudinal section, of a tubular to which a centraliser of the present disclosure is mounted.

In FIG. 2 is shown the underside of the shell 10. The cavity 26 is bounded by the base 23, 23', 25, 25' respectively of each shallow side wall 13, 13', 15, 15' at the periphery of the shell, and inwardly in proximity to the longitudinal slot 14 by upset cavity boundary walls 21, 21', 22, 22'. At each end of the longitudinal slot 14 the cavity boundary walls 21, 21', 22, 22' define recesses 24, 24' under the curved upper surface 12 of the shell 10. These recesses are open towards the longitudinal slot 14 as shown in FIG. 5.

Figure 3:
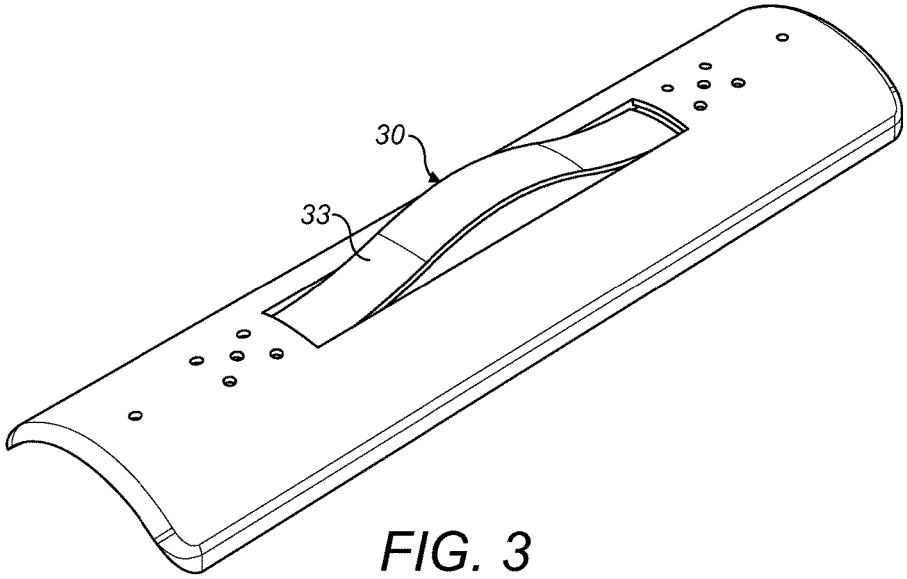
FIG. 3 is a perspective view from above and to one side of a shell as illustrated in FIG. 1, into which an elongate resilient member is fitted.
Figure 4:
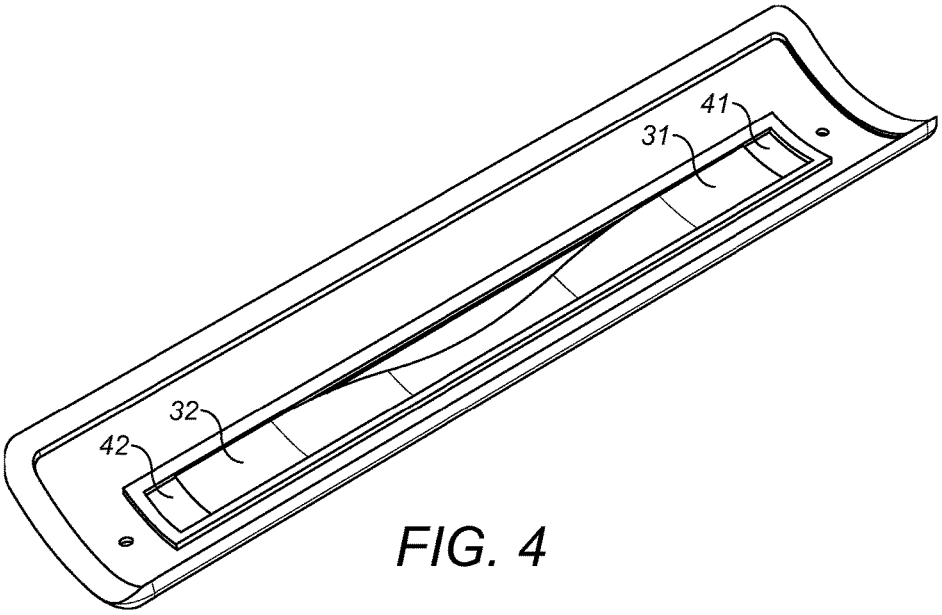
FIG. 4 is a perspective view from below and to one side of a shell as illustrated in FIG. 2, into which an elongate resilient member is fitted.

An elongate resilient member 30 in the form of a composite material strip with an outwardly projecting bow spring surface 33 may be retained in the shell 10 as illustrated in FIGS. 3 and 4. Each end 31, 32 of the elongate resilient member 30 is insertable in the respective recesses 24, 24' with sufficient axial clearance 41, 42 to permit longitudinal extension or elongation of the elongate resilient member 30 when the bow spring surface 33 is depressed. One of the ends 31 or 32 may be provided with mechanical means for fixing engagement with the recess, such as retention lugs, projections or pins configured to fit in corresponding sockets, slots or bores. A bonding agent may be used to fixedly retain the one end 31 or 32 in the corresponding recess 24, 24'. Fixing of only one end 31 or 32 in this manner permits that end (leading root of bow spring) to be drawn when the elongate resilient member 30 is passed through a restriction allowing the bow spring surface 33 of the elongate resilient member 30 to be depressed (partially flattened), and the other end (trailing root) to extend backwards into its recess 24 or 24' to avoid deleterious deformation or damage of the elongate resilient member 30.

When the shell 10 is to be positioned upon a tubular 50 (FIG. 5), the elongate resilient member 30 may be first located upon the tubular 50 and the shell 10 overlaid such that the bow spring surface 33 emerges from the longitudinal slot 14, and extends outwardly with respect to the tubular 50, and the respective ends 31 and 32 are positioned in the recesses 24, 24'. Alternatively, the elongate resilient member 30 may be first located in the recesses 24, 24' before positioning upon the tubular 50.

Optionally, the longitudinal slot 14 may be isolated from the cavity 26 by a thin barrier such as a glass fibre layer to prevent bonding agent ingress during application of the assembled centraliser comprising the shell 10 and elongate resilient member 30 to an exterior surface of the tubular 50. A bonding agent can be injected via injection port(s) 19 into the cavity 26, to secure the assembled shell 10 and elongate resilient member 30 to the tubular.

Manufacture of Centraliser Housing:

In an embodiment, a permanent mould or form is designed and constructed according to shape requirements for a shell 10 to be manufactured for use as a housing in assembly of a centraliser, that is, the geometry required for the centraliser housing. A number of differing moulds may be produced to enable a variety of shapes and sizes of centraliser housing to be manufactured at will.

In an embodiment the mould is shaped to make a shell which has an elongate substantially rectilinear shape with an arcuate cross section with a curved upper surface 12, and shallow side walls 13, 13', 15, 15' defining under the curved upper surface 12 a cavity 26 within the shell. Means for forming a longitudinal slot 14 centrally positioned in the curved upper surface 12 of the shell 10 is provided in the mould.

The mould is also shaped to form cavity boundary walls 21, 21', 22, 22' on the underside of the shell. These cavity boundary walls are to be formed in proximity to the longitudinal slot 14 and extend longitudinally beyond the ends of the longitudinal slot 14 to form recesses 24, 24' under the curved upper surface 12 of the shell 10. The mould may be adapted to form vent holes 17 in the curved upper surface 12 of the shell 10 overlying the recesses 24, 24'. In other embodiments such vent holes 17 can be bored in the moulded shell 10 after it has been formed in the mould.

The mould is used to form composite-forming materials into a prefabricated shell 10 which has at least one cavity 26 within it to receive a bonding agent. Use of composite-forming materials in an embodiment of a method for forming the shell 10 will now be described.

The shells 10 may be formed from any suitable composite-forming material. The composite-forming material may be a fibre-reinforced resin material (FRP/GRP/GFK type material). The resin material may be a hardenable resin optionally including curing agents and curing modifiers. The resin may be self-curing, or provided in two components which harden when brought together. The two component system may be a matrix-forming (pre-polymer) component and a hardener. Suitable resins include epoxy resins, polyurethanes and polyurea resins including blends or hybrids thereof, and other curable resin components including polyester or polyol or polyamine components. The curing of the resin may be controlled by use of amine curing agents such as polyetheramines. Other additives may be present.

In an embodiment, a fibre mat is infused with a resin matrix. This is achievable by passing the fibre mat through a bath containing the resin matrix. Infusion may also be achievable in other ways, such as applying the resin matrix liberally to the fibre mat by pouring or spraying or by a pressure treatment to soak, or impregnate the fibre mat with the resin matrix.

Ceramic particulates, for example hard wearing materials such as a combination of zirconium dioxide and silicon nitride, optionally in bead form, may be applied to the resin matrix-infused fibre mat.

A friction modifying material such as fluorocarbon particulates providing a low friction coefficient also may be applied to the resin matrix-infused fibre mat.

The resin matrix-infused fibre mat may be introduced to the mould such that surfaces treated with the aforesaid particulates are adjacent to the mould surfaces. Multiple additional layers of the resin matrix-infused fibre mat, which may or may not each have been treated with particulates, may be laid up into the mould on to the first resin matrix-infused fibre mat lining the mould until a predetermined thickness is attained. Then the mould may be closed.

A resin filler matrix may be introduced into the mould using a low pressure resin transfer moulding process. In an example of such a process, a mixed resin and catalyst or resin curing agent are introduced, for example by injection, into a closed mould containing the resin matrix-infused fibre and particulates layup. In this way a composite shell may be formed.

The mould may be heated in order to achieve first cure.

By adopting similar moulding techniques a composite strip can be formed into a curved elongate resilient member 30 to be used as a bow spring element to be housed within the composite shell 10 to make up a bow spring centraliser.

Modification of a Tubular

In use of the prefabricated shell 10 and elongate resilient member 30 to form a bow spring centraliser, a selected outer surface area of a tubular 50 is prepared in order to provide a clean, dry substrate with an appropriate surface profile for receiving the shell.

A prefabricated shell 10 of appropriate dimensions is presented to the prepared area, so that bases 23, 23', 25, 25' of the walls 13, 13', 15, 15' are contiguous with the surface of the tubular 50. As mentioned above the shell 10 may already hold the elongate resilient member 30 in the recesses 24, 24', or it may be first positioned upon the tubular 50 before the shell 10 is over-laid upon it. The shell 10 may be held in position temporarily by use of releasable fastenings such as removable straps, or adhesive tape. A cavity 26 is thereby defined between interior surfaces of the shell 10 and the prepared area of the tubular 50.

A bonding material is injected into the shell cavity through one or more inlet ports 19 in the surface of the shell 10.

When a period sufficient for curing of the bonding material has elapsed, the straps and/or adhesive tape may be removed.

By this method the prefabricated shell 10 becomes bonded to the tubular 50.

The tubular 50 is thereby modified to have a surface mounted bow-spring centraliser 60 which facilitates appropriate positioning of the tubular in a bore whilst offering reduced inhibition of fluid flow circulation within a bore in which the tubular is to be centralised since no collar or cylindrical body is used.

Figure 6:
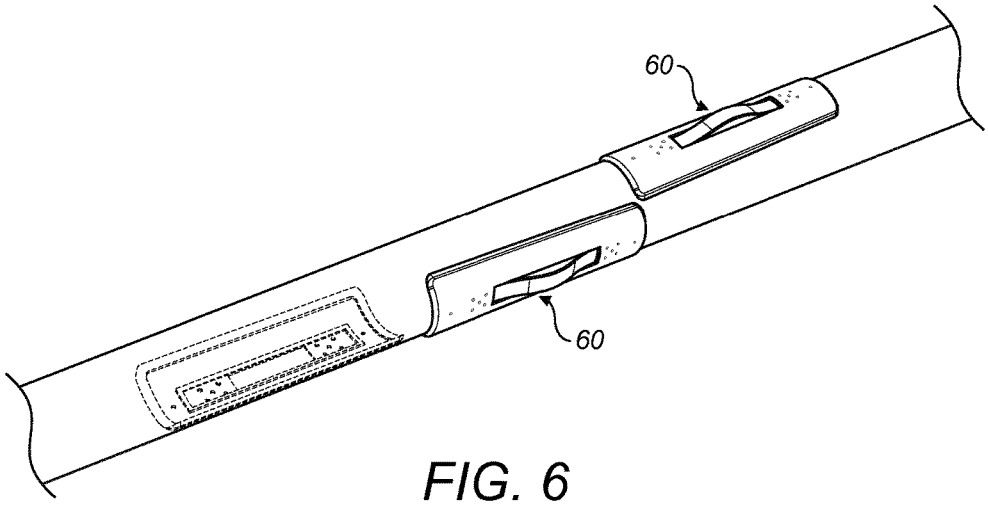
FIG. 6 is a perspective view from above and to one side of a tubular to which multiple centralisers of the present disclosure are attached in longitudinally spaced and radially offset positions.

Additional surface mounted bow-spring centralisers 60 may be formed on the tubular by repetition of the above described methods and procedures. As shown in FIG. 6 these may be staggered i.e. axially spaced along the length of the tubular 50 and at radially offset positions around the tubular 50.

According to an aspect of this disclosure, a composite centraliser comprises an elongate non-cylindrical housing having first and second recesses axially spaced on the elongate non-cylindrical housing, and an elongate resilient member having first and second ends, wherein the first and second ends are located in the respective first and second recesses of the elongate non-cylindrical housing, and a surface of the elongate resilient member is outwardly spaced from the elongate non-cylindrical housing. The elongate non-cylindrical housing may have a longitudinal slot in a surface thereof and the elongate resilient member may be movable within the slot. Presence of the longitudinal slot permits the elongate resilient member to retreat at least partially into the elongate non-cylindrical housing in use on a tubular, for example during passage of the tubular through a restriction in a bore.

The elongate non-cylindrical housing may be formed as a composite material shell with a cavity within for receiving a bonding agent. The elongate resilient member may be a composite material member formed into a curve to provide a bow spring.

According to another aspect of the disclosure, there is provided a method of attaching a centraliser to a tubular, wherein the method comprises providing an elongate non-cylindrical housing and an elongate resilient member having first and second ends, wherein the elongate non-cylindrical housing comprises a multi-layer composite material shell having at least one cavity within the multi-layer composite material shell for receiving a bonding agent, and wherein the elongate non-cylindrical housing has an outer surface with at least one port for introduction of a bonding agent, and preferably has a longitudinal slot for receiving the elongate resilient member, and first and second recesses axially spaced on the housing for receiving the first and second ends of the elongate resilient member, positioning the elongate resilient member with respect to the elongate non-cylindrical housing such that a portion of the elongate resilient member emerges outwardly from the elongate non-cylindrical housing, for example, through the longitudinal slot, whilst the respective first and second ends of the elongate resilient spring member are located in respective first and second recesses, positioning the elongate non-cylindrical housing on an external surface of a tubular and retaining the housing in position on the tubular, introducing a bonding agent into the cavity via the said at least one port, and allowing the bonding agent to bond the elongate non-cylindrical housing to the external surface of the tubular.

The method may comprise introducing at least one further centraliser by repetition of the aforesaid method steps, and positioning same such that the respective centralisers are staggered, i.e. axially spaced along the length of the tubular and at radially offset positions around the tubular.

Advantages of embodiments include the ability to provide standoff where tubulars have to pass through a restriction, or into an underreamed well bore, to a zone where the tubulars are to be set in a centralised position;

Staggered application to a tubular ensures maximum fluid bypass, as opposed to existing technology where collars or bodies occupy and limit annular space 100% non-metallic construction is possible by use of composite materials for the pre-fabricated shell 10 used to form an elongate non-cylindrical housing for the centraliser and for the elongate resilient member 30, which together are used to form a composite material bow spring centraliser.

Bow springs are protected by the shell body of the housing during introduction of the tubular into a bore.

No collar or cylindrical body is present, which permits use for expandable tubular applications.

Variations, modifications of the disclosed embodiments contemplated by the person skilled in the field are within the scope of the disclosure, and with regard to scope, attention is directed to the following claims which form part of the present disclosure and extend to all equivalents of the disclosed subject matter.

The invention claimed is:

1. A composite centraliser comprising:

an elongate non-cylindrical housing having an arcuate surface, wherein first and second recesses are defined in an inside of the arcuate surface, the first and second recesses being axially spaced on the elongate non-cylindrical housing, and an elongate resilient member having first and second ends, wherein the first and second ends are located in the respective first and second recesses of the elongate non-cylindrical housing, such that the first end is retained in the first recess at least partially by engagement with the inside of the arcuate surface in the first recess, and wherein a surface of the elongate resilient member is outwardly spaced from the elongate non-cylindrical housing, wherein the elongate non-cylindrical housing has a longitudinal slot extending through the arcuate surface and between the first and second recesses, wherein, as proceeding from the first end, the elongate resilient member extends outward through the slot, projects outwardly from the elongate non-cylindrical housing, and extends inward through the slot to the second end.

2. A centraliser as claimed in claim 1, wherein the elongate non-cylindrical housing has an arcuate cross-section.

3. A centraliser as claimed in claim 1, wherein at least one of said first and second ends of the elongate resilient member is movably retained without fasteners in one of the corresponding first and second recesses to allow axial movement of the elongate resilient member.

4. A centraliser as claimed in claim 1, wherein one of said first and second ends of the elongate resilient member is restrained against axial movement in one of the corresponding first and second recesses.

5. A centraliser as claimed in claim 1, wherein one of said first and second ends of the elongate resilient member is slidably retained in one of the corresponding first and second recesses, and the other of said first and second ends of the elongate resilient member is restrained against axial movement in the other of the corresponding first and second recesses.

6. A centraliser as claimed in claim 1, wherein the elongate non-cylindrical housing comprises a multi-layer composite material shell having at least one cavity within the shell for receiving a bonding agent.

7. A centraliser as claimed in claim 6, wherein the multi-layer composite material shell comprises a wear resistant composite surface, and at least one structural reinforcement layer comprising reinforcing fibres selected from the group consisting of carbon fibres, aromatic polyamide (aramid) fibres, and glass fibres.

8. A centraliser as claimed in claim 6, wherein the shell has an undersurface comprising side walls configured to provide a boundary around the longitudinal slot.

9. A centraliser as claimed in claim 6, wherein the elongate non-cylindrical housing has an outer surface with at least one port for introduction of a bonding agent.

10. A centraliser as claimed in claim 1, wherein the elongate resilient member comprises a fibre-reinforced resin formed into an elongate resilient curved strip to provide a bow spring.

11. A centraliser as claimed in claim 10 wherein the fibre-reinforced resin comprises at least one of carbon fibres, aromatic polyamide (aramid) fibres, and glass fibres.

12. A centraliser as claimed in claim 10, wherein the fibre-reinforced resin comprises a material selected from the group consisting of: an epoxy resin, a polyurethane resin, a polyuria resin, a blend or hybrid including a polyurethane resin, a blend or hybrid including a polyuria resin, a polyester, a polyol, and a polyamine.

13. A method of attaching a centraliser to a tubular, the method comprising:

providing an elongate non-cylindrical housing and an elongate resilient member having first and second ends, wherein the elongate non-cylindrical housing comprises a multi-layer composite material shell having an arcuate surface and at least one cavity within the multi-layer composite material shell for receiving a bonding agent, and wherein the elongate non-cylindrical housing has an outer surface with at least one port for introduction of a bonding agent, and a longitudinal slot for receiving the elongate resilient member, and first and second recesses axially spaced on the housing for receiving the first and second ends of the elongate resilient member, wherein the longitudinal slot extends between the first and second recesses, positioning the elongate resilient member with respect to the elongate non-cylindrical housing such that a portion of the elongate resilient member emerges outwardly through the longitudinal slot whilst the respective first and second ends of the elongate resilient member are located in respective first and second recesses, wherein, as proceeding from the first end, the elongate resilient member extends outward through the slot, projects outwardly from the elongate non-cylindrical housing, and extends inward through the slot to the second end, positioning the elongate non-cylindrical housing on an external surface of a tubular and retaining the elongate non-cylindrical housing in position on the tubular, wherein the first end of the elongate resilient member is entrained radially between the tubular and an inside of an arcuate surface of the housing without a fastener being attached to the first end, introducing a bonding agent into the cavity via the said at least one port, and allowing the bonding agent to bond the elongate non-cylindrical housing to the external surface of the tubular.

14. A method according to claim 13, further comprising introducing at least one further centraliser, and positioning each further centraliser such that the respective centralisers are axially spaced along the length of the tubular and at radially offset positions around the tubular.

15. A composite centraliser comprising:

an elongate non-cylindrical housing comprising an arcuate surface having an inside that faces a tubular when the housing is coupled to the tubular, wherein the arcuate surface defines a longitudinal slot therethrough, a first recess on the inside of the arcuate surface, and a second recess on the inside of the arcuate surface, wherein the first and second recesses do not extend through the arcuate surface and extend away from the slot, wherein the longitudinal slot is positioned between the first and second recesses; and an elongate resilient member having a first end and a second end, wherein as proceeding from the first end, the resilient member extends outward through the slot, projects outwardly from the elongate non-cylindrical housing, and extends inward through the slot to the second end, and wherein the first end is received in the first recess such that the first end is entrained between the housing and the tubular when the housing is coupled to the tubular.

16. The centraliser of claim 15, wherein the second recess extends away from the slot such that the first and second recesses are on opposite longitudinal ends of the slot, and wherein the second end of the elongate resilient member is entrained between the housing and the tubular when the housing is coupled to the tubular.

17. The centraliser of claim 16, wherein the second end is fastened or bonded in the second recess so as to prevent displacement of the second end with respect to the housing, and wherein the first end is free from fasteners or bonding, so as to allow a range of movement for the first end with respect to the housing.

18. The centraliser of claim 15, wherein the housing defines vent holes communicating radially therethrough with the first recess.

19. The centraliser of claim 15, wherein the housing defines a cavity on the inside of the arcuate surface, the cavity being separated from the first and second recesses, wherein the housing is configured such that the cavity is filled with bonding material when the housing is coupled to the tubular.

* * * * *